US007490378B2

(12) United States Patent
Le Gette et al.

(10) Patent No.: US 7,490,378 B2
(45) **Date of Patent: *Feb. 17, 2009**

(54) FRAME MEMBER AND ATTACHED MEMBRANES

(75) Inventors: Brian E. Le Gette, Severna Park, MD (US); Tai Hoon Kim Matlin, Skokie, IL (US); James Ashley Waring, Vernon Hill, IL (US); Ronald L. Wilson, II, Vienna, WV (US)

(73) Assignee: Kelsyus, LLC, Virginia Beach, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/554,220

(22) Filed: Oct. 30, 2006

(65) Prior Publication Data

US 2008/0098531 A1 May 1, 2008

Related U.S. Application Data

(63) Continuation of application No. 11/178,429, filed on Jul. 12, 2005, now Pat. No. 7,127,754, which is a continuation of application No. 10/635,454, filed on Aug. 7, 2003, now Pat. No. 6,915,537, which is a continuation of application No. 10/043,279, filed on Jan. 14, 2002, now Pat. No. 6,634,040, which is a continuation of application No. 09/533,963, filed on Aug. 15, 2000, now Pat. No. 6,343,391, which is a continuation of application No. 09/229,968, filed on Jan. 14, 1999, now abandoned, which is a continuation-in-part of application No. 09/081,134, filed on May 19, 1998, now Pat. No. 6,170,100.

(51) Int. Cl.
*A47G 9/06* (2006.01)

(52) U.S. Cl. ..... 5/417; 5/419; 5/420

(58) Field of Classification Search ..... 5/413 R, 5/494, 496, 498, 485, 490, 417–420; 160/387, 160/370.21
See application file for complete search history.

(56) References Cited

U.S. PATENT DOCUMENTS

| | | | |
|---|---|---|---|
| 722,801 | A | 3/1903 | Bourne, Jr. |
| 772,690 | A | 10/1904 | Baswitz |
| 856,279 | A | 6/1907 | Moore |
| 1,190,743 | A | 7/1916 | Fageol |
| 1,479,903 | A | 1/1924 | Erland |
| 1,960,474 | A | 5/1934 | Browne |
| 2,119,023 | A | 5/1938 | Pickard |
| 2,173,963 | A | 9/1939 | Eubank |
| 2,190,566 | A | 2/1940 | Julian |
| 2,207,025 | A | 7/1940 | Rison |
| 2,334,924 | A | 11/1943 | Hansen |
| 2,344,010 | A | 3/1944 | Walsh |

(Continued)

FOREIGN PATENT DOCUMENTS

EP 0 974 293 A2 1/2000

(Continued)

*Primary Examiner*—Michael Trettel
(74) *Attorney, Agent, or Firm*—Cooley Godward Kronish LLP

(57) ABSTRACT

A collapsible apparatus includes a frame member being formed from a flexible twistable material, a first membrane and a second membrane, and an inflatable bladder. The second membrane is removably attachable to the first membrane.

20 Claims, 13 Drawing Sheets

U.S. PATENT DOCUMENTS 2,357,789 A 9/1944 Levy
2,360,715 A 10/1944 Perry
2,420,344 A 5/1947 Alexander
2,442,105 A 5/1948 Vacheron
2,637,861 A 5/1953 Kethledge
2,731,997 A 1/1956 Muth et al.
2,803,291 A 8/1957 Meyer
2,803,839 A 8/1957 Mosley
2,870,464 A 1/1959 Lalick
3,052,895 A 9/1962 Lo Vico
3,333,610 A 8/1967 Geddings
3,339,218 A 9/1967 Stamberger
3,602,930 A 9/1971 Channon
3,775,782 A 12/1973 Rice et al.
3,842,454 A 10/1974 Young
3,860,976 A 1/1975 Suyama
3,862,876 A 1/1975 Graves
3,960,161 A 6/1976 Norman
3,990,463 A 11/1976 Norman
4,097,944 A 7/1978 Yulish
4,200,942 A 5/1980 Case
4,231,125 A 11/1980 Tittl
D261,464 S 10/1981 Smith
4,296,788 A 10/1981 Slater
4,478,587 A 10/1984 Mackal
4,512,049 A 4/1985 Henry
4,561,480 A 12/1985 Underwood et al.
4,576,375 A 3/1986 Roberts
4,709,430 A 12/1987 Nicoll
4,766,918 A 8/1988 Odekirk
4,815,784 A 3/1989 Zheng
4,825,892 A 5/1989 Norman
4,856,912 A 8/1989 Damus et al.
4,858,634 A 8/1989 McLeese
4,861,300 A 8/1989 Casagrande et al.
4,942,838 A 7/1990 Boyer et al.
4,944,707 A 7/1990 Silverglate
4,946,067 A 8/1990 Kelsall
4,951,333 A 8/1990 Kaiser et al.
4,976,642 A 12/1990 Wilkie
5,024,262 A 6/1991 Huang
5,038,812 A 8/1991 Normal
5,045,011 A 9/1991 Lovik
5,056,172 A 10/1991 Kaiser et al.
5,059,463 A 10/1991 Peters
5,070,807 A 12/1991 Lewis
D325,489 S 4/1992 Pratt
5,116,273 A 5/1992 Chan
5,123,869 A 6/1992 Schipmann
D328,324 S 7/1992 Wang
5,163,192 A 11/1992 Watson
5,163,461 A 11/1992 Ivanovich et al.
D331,482 S 12/1992 Mitchell
5,186,667 A 2/1993 Wang
5,206,964 A 5/1993 Wilson, Sr.
5,213,147 A 5/1993 Zheng
5,261,131 A 11/1993 Kilby
5,299,331 A 4/1994 Badillo
D349,593 S 8/1994 Hensley
5,334,067 A 8/1994 Henry et al.
5,345,627 A 9/1994 Cammarata
5,358,440 A 10/1994 Zheng
5,385,518 A 1/1995 Turner
5,396,917 A 3/1995 Hazinski et al.
5,430,980 A 7/1995 Ferrier
5,433,433 A 7/1995 Armell
5,435,024 A 7/1995 Capshaw
5,435,025 A 7/1995 Gerard et al.
5,454,643 A 10/1995 Sullivan
5,467,794 A 11/1995 Zheng
5,473,785 A 12/1995 Lager et al.
D366,177 S 1/1996 Dean
5,499,417 A 3/1996 Wang
5,520,561 A 5/1996 Langenohl
5,533,653 A 7/1996 Kaufman
5,560,385 A 10/1996 Zheng
5,571,036 A 11/1996 Hannigan
5,579,799 A 12/1996 Zheng
5,592,961 A 1/1997 Chin
D378,772 S 4/1997 Hall
5,618,110 A 4/1997 Sullivan
5,618,246 A 4/1997 Zheng
5,619,759 A 4/1997 Hansen et al.
5,629,071 A 5/1997 Feldman
RE35,571 E 7/1997 McLeese
5,644,807 A 7/1997 Battistella
5,688,052 A 11/1997 Compton
5,693,398 A 12/1997 Granger
D389,362 S 1/1998 Boulatian
5,718,612 A 2/1998 Elsholz
5,729,846 A 3/1998 Sullivan
5,730,529 A 3/1998 Fritz et al.
5,810,695 A 9/1998 Sass
D400,749 S 11/1998 Bechtold, Jr.
5,885,123 A 3/1999 Clifford
5,976,023 A 11/1999 Cho
6,030,300 A 2/2000 Zheng
D425,357 S 5/2000 Waring
D426,415 S 6/2000 Le Gette et al.
6,073,283 A 6/2000 Zheng
6,113,453 A 9/2000 Stuffelbeam
6,170,100 B1 1/2001 Le Gette et al.
6,192,635 B1 2/2001 Zheng
6,223,673 B1 5/2001 Mears et al.
6,225,940 B1 5/2001 Ohlsen
6,276,979 B1 8/2001 Saltel
D447,661 S 9/2001 Le Gette et al.
D449,193 S 10/2001 Le Gette et al.
6,343,391 B1 2/2002 Le Gette et al.

FOREIGN PATENT DOCUMENTS

FR 2400873 3/1979
GB 258077 9/1926

FRAME MEMBER AND ATTACHED MEMBRANES

CROSS-REFERENCE TO RELATED PATENT APPLICATIONS

This patent application claims priority to and is a continuation of U.S. application Ser. No. 11/178,429, entitled "Frame Member and Attached Membranes," filed Jul. 12, 2005, (now U.S. Pat. No. 7,127,754), which is a Continuation of U.S. application Ser. No. 10/635,454, entitled "Frame Member and Attached Membranes" filed Aug. 7, 2003 (now U.S. Pat. No. 6,915,537), which is a Continuation of U.S. application Ser. No. 10/043,279, entitled "Towel-Mat with a frame Member and Removably Attached Membranes," filed on Jan. 14, 2002 (now U.S. Pat. No. 6,634,040), which is a continuation of U.S. application Ser. No. 09/533,963 entitled "Towel-Mat with a Frame Member and Removably Attached Membranes," filed on Aug. 15, 2000 (now U.S. Pat. No. 6,343,391), which is a Continuation of U.S. application Ser. No. 09/229,968, entitled "Towel-Mat with a Frame Member and Removably Attached Membranes," filed on Jan. 14, 1999 (now abandoned), which is a Continuation-in-Part of U.S. application Ser. No. 09/081,134, entitled "A Self-Opening Towel," filed on May 19, 1998 (now U.S. Pat. No. 6,170,100); the disclosures of which are incorporated herein by reference.

This patent application is related to commonly assigned U.S. patent application Ser. No. 09/229,966 entitled, "Collapsible Frame," filed on Jan. 14, 1999 (now abandoned) and which is incorporated herein by reference.

BACKGROUND OF THE INVENTION

The present invention generally relates to a towel-mat having a frame member and removably attached membranes.

Conventional beach towels and picnic blankets are typically used, for example, to separate a person from the ground (e.g., beach sand) and/or to line a chair. Difficulty exists, however, in maintaining the shape of these items when being used for such purposes. For example, when a beach towel is used to separate a person from the beach sand, the towel will typically lose its spread out shape and converge towards the person.

Several attempts have been tried to remedy these problems with towels. For example, U.S. Pat. No. 3,862,876, issued to Graves, discloses one attempt to maintain the desired shape of a towel. The towel in Graves has continuous flexible weights secured along two opposed edges of the towel. U.S. Pat. No. 4,709,430, issued to Nicoll, discloses a beach blanket having a non-metallic tube filled with a liquid weight such as water located at the perimeter of the blanket.

These known towels, however, can be difficult to arrange when configured to have a large size. These towels can be cumbersome to arrange for separating a person from the beach sand, to line a chair, and to pack for removal.

SUMMARY OF THE INVENTION

An apparatus includes a frame member being formed from a flexible twistable material, a first membrane and a second membrane. The first membrane has a perimeter portion to which a frame member is fixedly attached. The second membrane has a perimeter portion. The second membrane is removably attachable to the first membrane.

In one embodiment, the second membrane is removably attachable to the first membrane along the perimeter portion of the second membrane and along the perimeter portion of the first membrane.

In another embodiment, the perimeter portion of the second membrane includes an extended portion. The extended portion and the perimeter portion of the second membrane forms a perimeter pocket adapted to receive the first membrane.

In yet another embodiment, the apparatus further comprises a fastener having a first portion and a second portion. The first portion of the fastener is attached to the first membrane, and the second portion of the fastener is attached to the second membrane. The fastener is adapted to removably attach the first membrane to the second membrane.

DETAILED DESCRIPTION

A towel-mat includes a frame member being formed from a flexible twistable material, a first membrane and a second membrane. The first membrane has a perimeter portion to which a frame member is fixedly attached. The second membrane has a perimeter portion. The second membrane is removably attachable to the first membrane.

The term "membrane" is used herein to include, but is not limited to, a layer of material. For example, the membrane can be a piece of fabric such as terry cloth or nylon. In one embodiment, for example, one membrane (e.g., the second membrane which can form a top membrane of the towel-mat) can be a machine-washable fabric such as terry cloth to face the user comfortably; the other membrane (e.g., the first membrane with the frame member fixedly attached which can form a bottom membrane of the towel-mat) can be a fabric, not necessarily machine washable, such as nylon to face the ground.

The term "perimeter portion" is used herein to include an area substantially about the perimeter of a membrane. The perimeter portion can be, for example, twenty percent of the membrane area nearest to the membrane perimeter.

In one embodiment, the perimeter portion of the second membrane includes an extended portion and a facing portion. The extended portion and the facing portion of the second membrane forms a perimeter pocket adapted to receive the first membrane. The term "extended portion" is used herein to include, but is not limited to, a portion of a membrane extending beyond the membrane perimeter. For example, the extended portion can include a portion of the membrane that is folded over at the perimeter. The extended portion can be made of the same material as the membrane itself or can be made of a material different from the membrane, for example, an elastic material sewn to a nylon membrane. The term "facing portion" is used herein to include a portion of a membrane that faces the extended portion of the membrane.

The "perimeter pocket" formed by the extended portion and the facing portion of the membrane can be any type of cavity or opening along at least a portion of the perimeter. In one embodiment, the frame member is fixedly attached along the perimeter of one towel-mat membrane (e.g., the lower membrane) which is, in turn, inserted into the perimeter pocket of another membrane (e.g., the top membrane); the extended portion can be an elastic material which is stretched over the lower membrane so that it is disposed within the perimeter pocket formed by the extended portion and the facing portion of the lower membrane.

Figure 1:
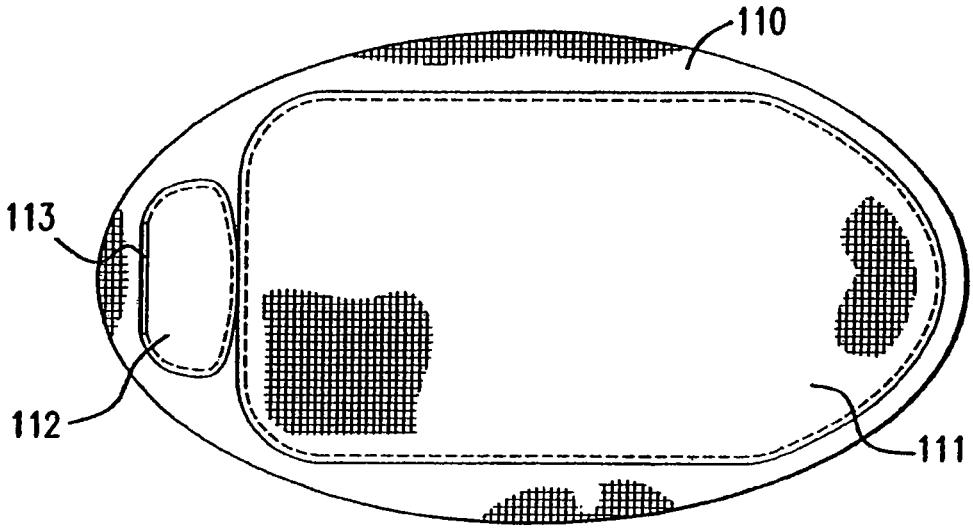
FIG. 1 shows a top view of a top membrane of a towel-mat according to an embodiment of the present invention.
Figure 2:
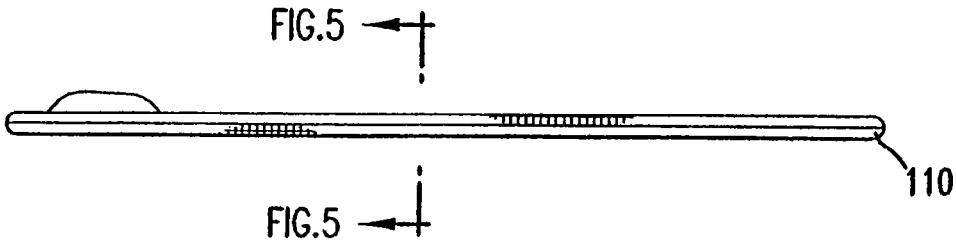
FIG. 2 shows a side view of the top membrane shown in FIG. 1.
Figure 3:
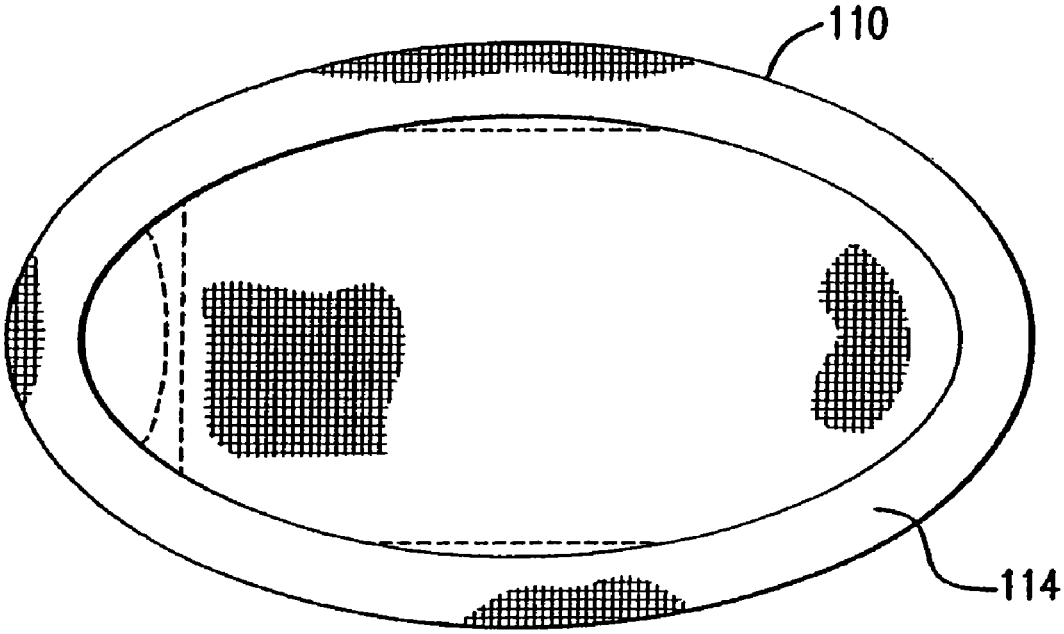
FIG. 3 shows a bottom view of the top membrane shown in FIGS. 1 and 2.

FIG. 1 shows a top view of a top membrane of a towel-mat according to an embodiment of the present invention. FIG. 2 shows a side view of the top membrane shown in FIG. 1. FIG. 3 illustrates a bottom view of the top membrane for the towel-mat shown in FIGS. 1 and 2.

A towel-mat includes a top membrane 110 and a bottom membrane 120. A body portion 111 and a head portion 112 can be fixedly attached to top membrane 110. Body portion 111 and head portion 112 can be fixedly attached to the top membrane 110 by, for example, sewing along the perimeters of those portions. Head portion 112 can be sewn along a portion of the perimeter of the head portion 112 to provide an opening 113 where a pillow can be inserted as will be discussed below.

Top membrane 110 includes an extended portion 114, which is located on the underside of the top membrane 110 from the top view perspective. Extended portion 114 and the facing portion of top membrane 110 form a pocket into which the bottom membrane 120 can be removably inserted. The extended portion 114 can be made, for example, an elastic material that can be stretched over lower membrane 120 to better place lower membrane 120 within the pocket. In other words, the bottom membrane 120 can be removably attached to the top membrane 110 by placing lower membrane 120 within the pocket formed by extended portion 114 and top membrane 110.

Figure 4:
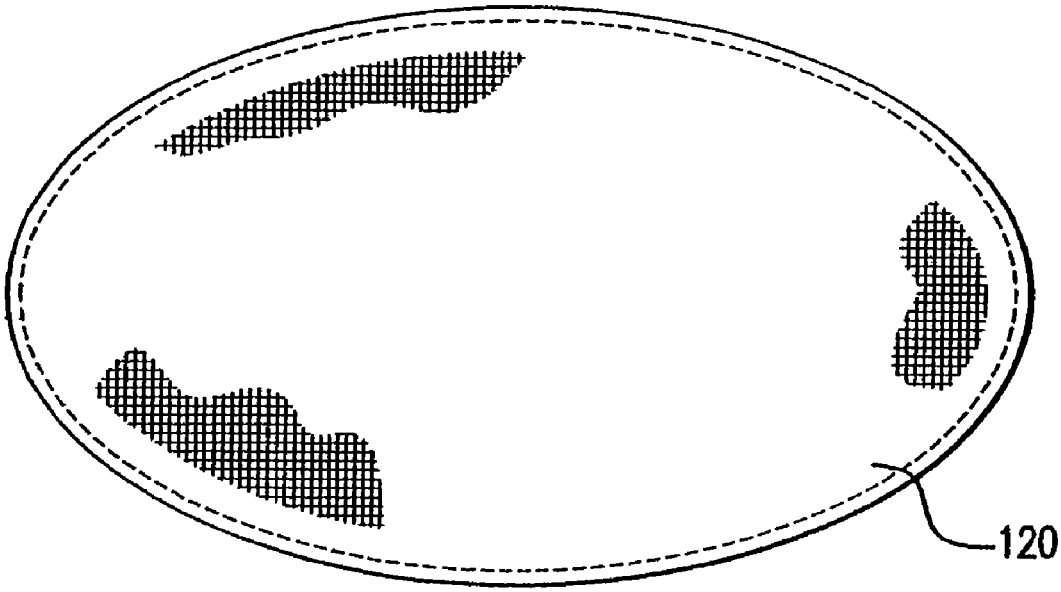
FIG. 4 shows a bottom or top view of the bottom membrane for attachment to the top membrane shown in FIGS. 1 through 3.

FIG. 4 shows a bottom or top view of the bottom membrane for attachment to the top membrane shown in FIGS. 1 through 3. The lower membrane 120 has the frame member (not shown) fixedly attached. The lower membrane 120 can be folded over the frame member and then sewn along the interior of the lower membrane 120. In other words, lower membrane 120 can have an oval shape; the frame member can be placed along the perimeter and then the lower membrane 120 can be sewn along the inner perimeter to capture the frame member within the doubled-over lower membrane. Because the frame member is captured within the lower membrane 120, the frame member is essentially fixedly attached to the lower membrane 120.

Figure 5:
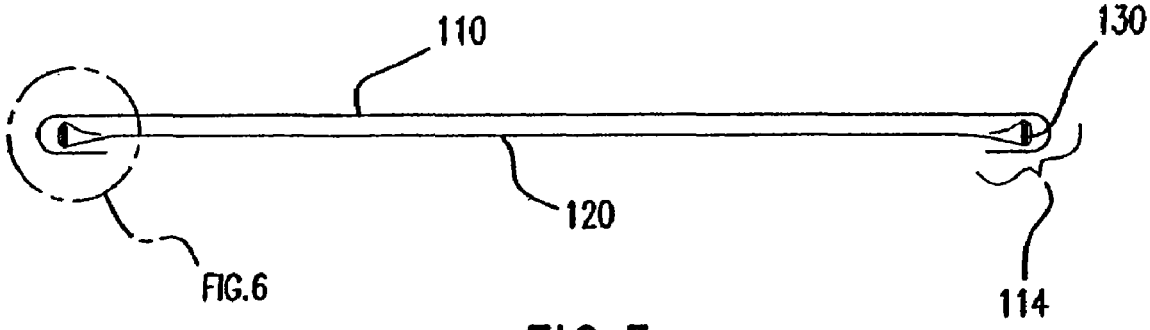
FIG. 5 shows a cross-sectional view of the top membrane shown in FIG. 1 along line A and the bottom membrane inserted into the perimeter pocket of the top membrane.

FIG. 5 shows a cross-sectional view of the top membrane shown in FIG. 1 along line A and the lower membrane inserted into the perimeter pocket of the top membrane. As shown in FIG. 5, the lower membrane 120 is placed within the pocket formed by top membrane 110 and extended portion 114. FIG. 5 illustrates the frame member 130 located along the perimeter of lower membrane 120.

Figure 6:
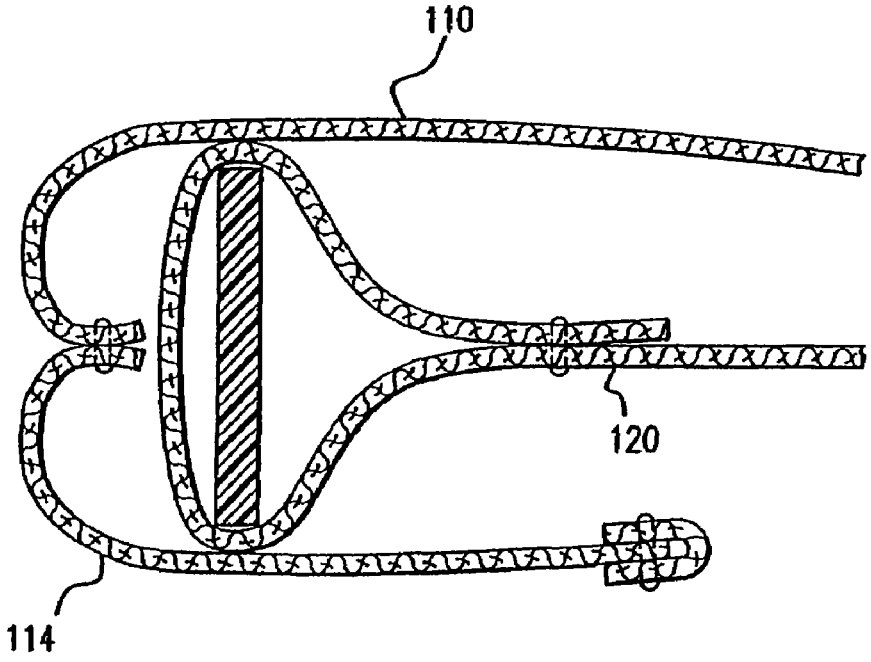
FIG. 6 illustrates one manner in which the membranes of the towel-mat shown in FIGS. 1-5 can be constructed, according to an embodiment of the present invention.

FIG. 6 shows an exploded view of the end portion of the cross-section shown in FIG. 5. FIG. 6 illustrates one manner in which the membranes of the towel-mat shown in FIGS. 1-5 can be constructed, according to an embodiment of the present invention. As shown in FIG. 6, lower membrane 120 can be folded over frame member 130 and sewn along that inner perimeter of lower membrane 120, which is solid along its interior. In an alternative embodiment, the lower membrane 120 has a hole within its interior and the frame member is sewn along a perimeter portion.

As FIG. 6 illustrates, top membrane 110 can be sewn to extended portion 114 so that the seam is on the interior of the towel. The far end of extended portion 114 can be sewn with a binding.

Figure 7:
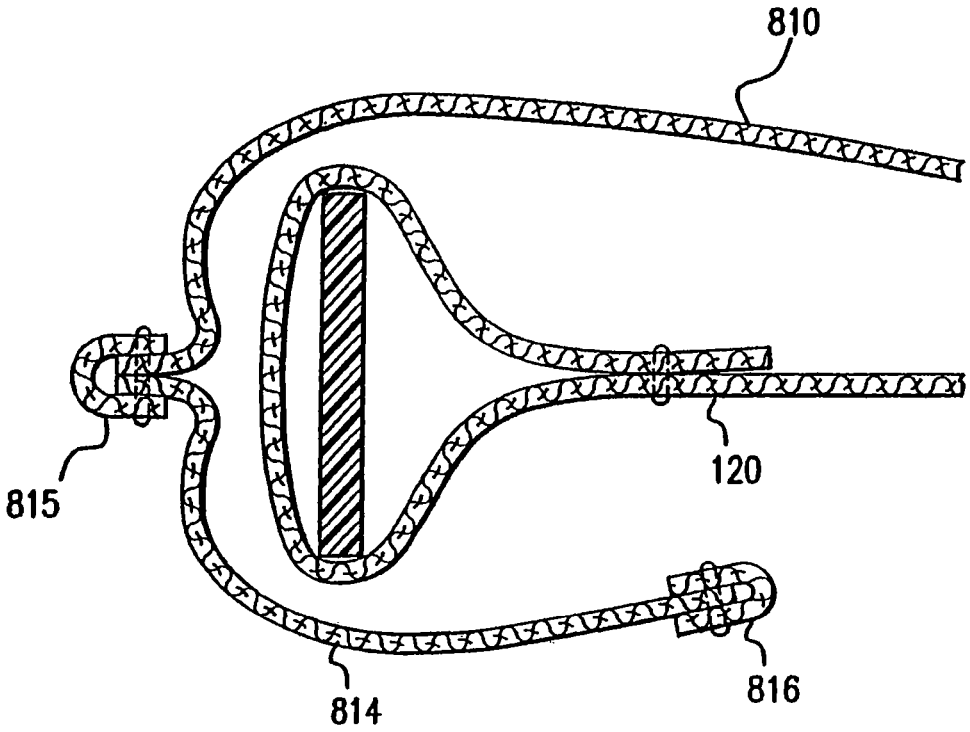
FIG. 7 illustrates an alternative manner in which the membranes of a towel-mat can be constructed according to another embodiment of the present invention.

FIG. 7 illustrates an alternative manner in which the membranes of a towel-mat can be constructed according to another embodiment of the present invention. As FIG. 7 illustrates, the top membrane 810 and extended portion 814 can be sewn with an exterior seam 815 and then have a binding placed over the seam. The far end of the extended portion, again, can have a binding 816.

Figure 8:
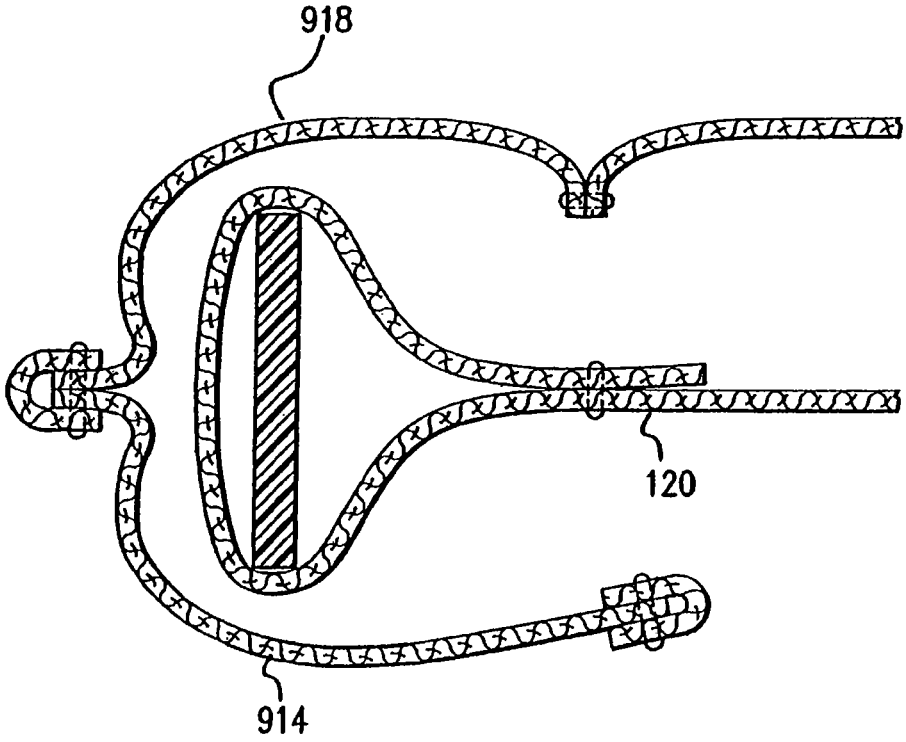
FIG. 8 illustrates yet another manner in which the membranes of the towel-mat can be constructed according to another embodiment of the present invention.

FIG. 8 illustrates yet another manner in which the membranes of the towel-mat can be constructed according to another embodiment of the present invention. As shown in FIG. 8, the top membrane can be constructed similar to that shown in FIG. 7 with an additional segment 918 attached to the extended portion 914.

Figure 9:
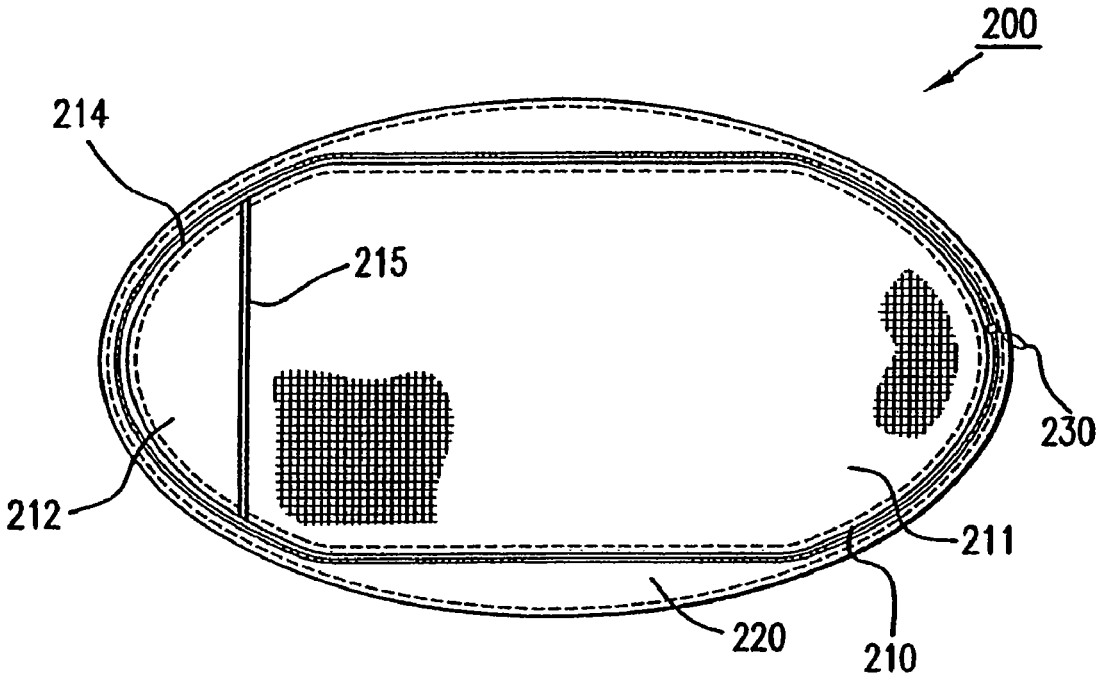
FIG. 9 illustrates a top view of a towel-mat with a frame member and removably attached membranes according to another embodiment of the present invention.

FIG. 9 illustrates a top view of a towel-mat with a frame member and removably attached membranes according to another embodiment of the present invention. Towel-mat 200 includes top membrane 210, lower membrane 220 and fastener 230. Top membrane can include a body portion 211 and a head portion 212. The frame member (not shown) is sewn along the perimeter of lower membrane 220. Fastener 230 has one portion attached to the top membrane 210 and another portion attached to the lower membrane 220. The portions of the fastener 230 can be, for example, attached along the perimeter portions of the top and lower membranes 210 and 220, respectively. The fastener can be, for example, a zipper, a hook and pile arrangement, a set of buttons with holes or a set of snaps. The particular fastener shown in FIG. 9 is a zipper.

The head portion 212 can be fixedly attached to body portion 211 by sewing the head portion 212 to the body portion 211 along the semi-circular outer perimeter 214 of the head portion 212. A opening can be formed along the straight side 215 of head portion 212 to allow a pillow to be removably inserted into the towel. Once head portion 212 has been attached to body portion 211, both portions can be fixedly attached to top membrane 220, for example, by sewing along the perimeter of body portion 211.

Figure 10:
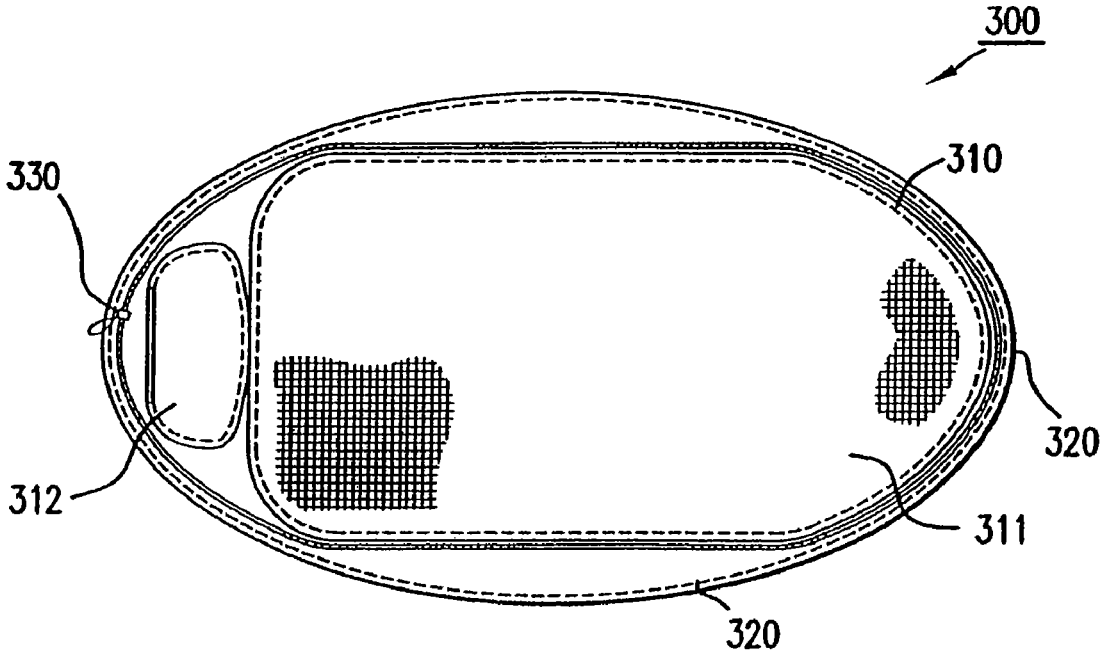
FIG. 10 illustrates a top view of a towel-mat with a frame member and removably attached membranes according to another embodiment of the present invention.
Figure 11:
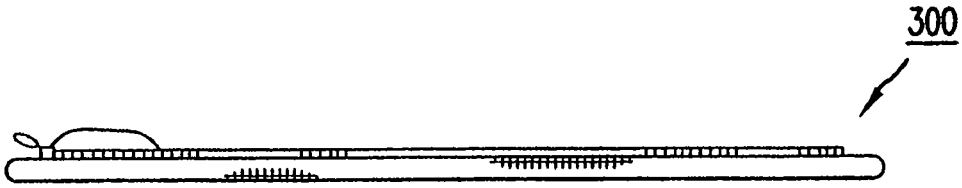
FIG. 11 shows a side view of the towel-mat shown in FIG. 10.
Figure 12:
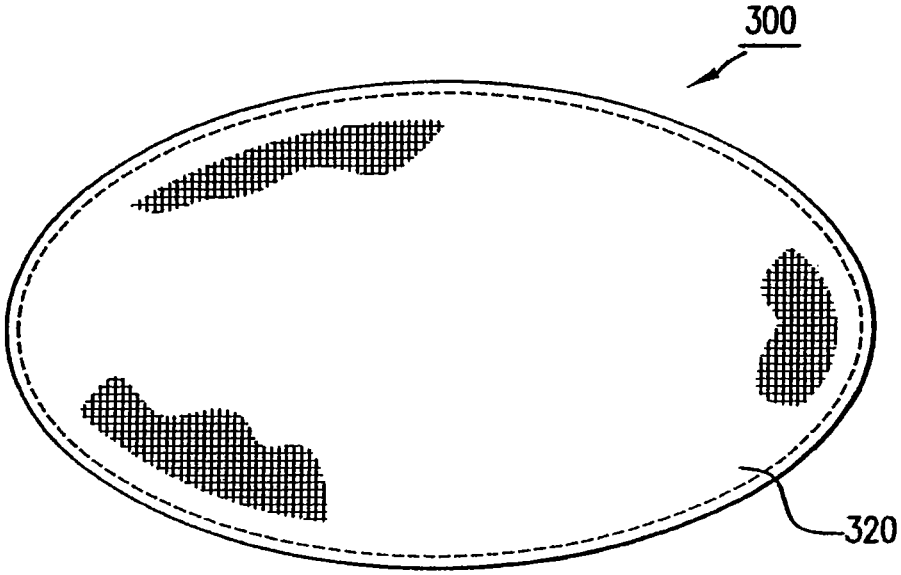
FIG. 12 illustrates a bottom or top view of the lower membrane of the towel-mat shown in FIGS. 10 and 11.

FIG. 10 illustrates a top view of a towel-mat with a frame member and removably attached membranes according to another embodiment of the present invention. FIG. 11 shows a side view of the towel-mat shown in FIG. 10. Towel-mat 300 includes top membrane 310, lower membrane 320 and fastener 330. Top membrane can include a body portion 311 and a head portion 312. FIG. 12 illustrates a bottom or top view of the towel-mat shown in FIGS. 10 and 11. The frame member (not shown) is sewn along the perimeter of lower membrane 320.

Fastener 330 has one portion that is to be attached to the top membrane 310 and another portion that is to be attached to the lower membrane 320. The portions of the fastener 330 can be, for example, attached along the perimeter portions of the top and lower membranes 310 and 320, respectively. The fastener can be, for example, a zipper, a hook and pile arrangement, a set of buttons with holes or a set of snaps. The particular fastener shown in FIGS. 10 and 11 is a zipper.

The head portion 312 can be fixedly attached to top membrane 310 by sewing the head portion 312 to the top membrane 310 along the semi-circular outer perimeter of the head portion 312. An opening can be formed along the straight side of head portion 312 to allow a pillow to be removably inserted into the towel.

Figure 13:
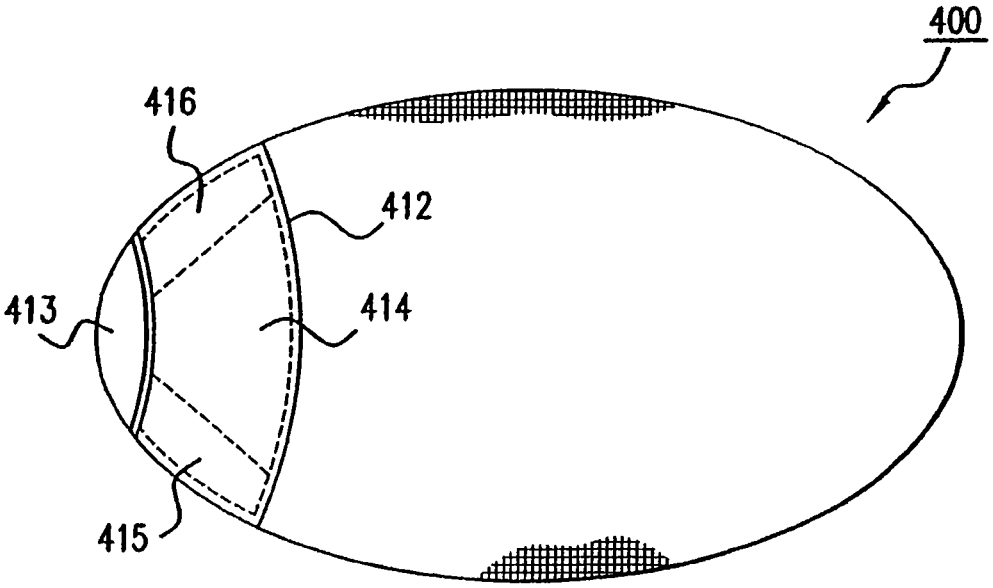
FIG. 13 illustrates a top view of a towel-mat according to another embodiment of the present invention.
Figure 14:
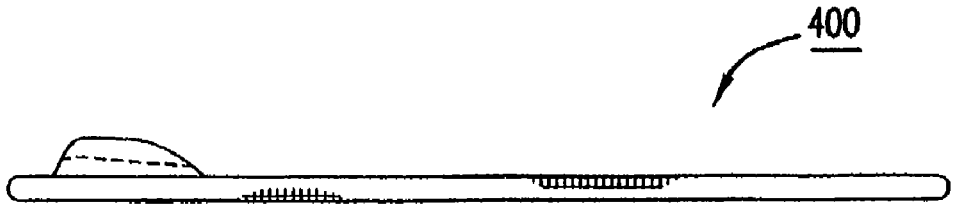
FIG. 14 illustrates a side view of the towel-mat shown in FIG. 13.

FIG. 13 illustrates a top view of a towel-mat according to another embodiment of the present invention. FIG. 14 illustrates a side view of the towel-mat shown in FIG. 13. Although many of the details of the towel-mat 400 are omitted from FIGS. 13 and 14 for clarity, the shown details are those that relate to the head portion of the top membrane. The head portion 412 can be sewn along three of the four sides of its perimeter and can be sewn along interior lines to form an opening 413 to a central pocket 414 (into which a pillow can be placed), left pocket 415 and right pocket 416 (into which miscellaneous items, such as sunglasses, keys and suntan lotion can be placed).

Figure 15:
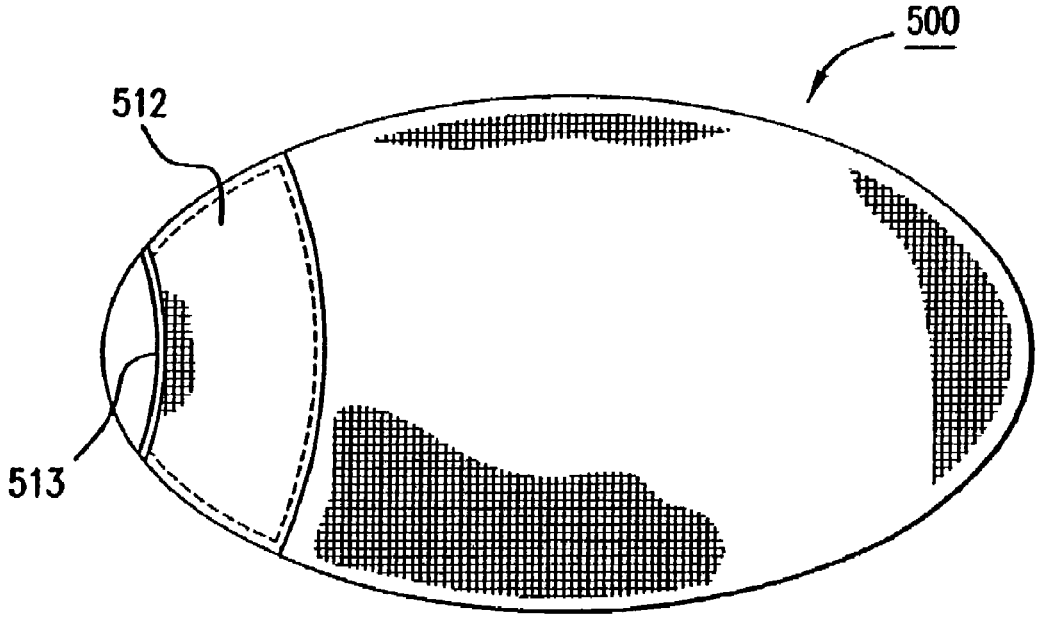
FIG. 15 shows a top view of a towel-mat according to another embodiment of the present invention.
Figure 16:
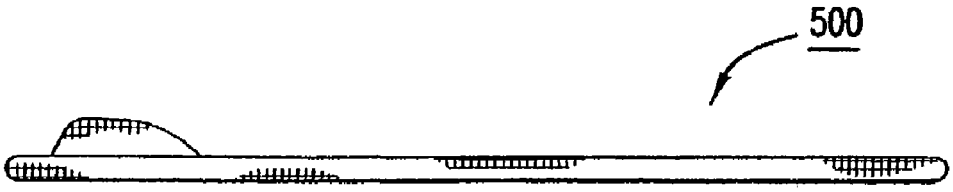
FIG. 16 shows a side view of the towel-mat shown in FIG. 15.

FIG. 15 shows a top view of a towel-mat according to another embodiment of the present invention. FIG. 16 shows a side view of the towel-mat shown in FIG. 15. Similar to the discussion above, the details again shown here relate to head portion 512, which has been sewn along three of its four sides to form a pocket 513.

Figure 17:
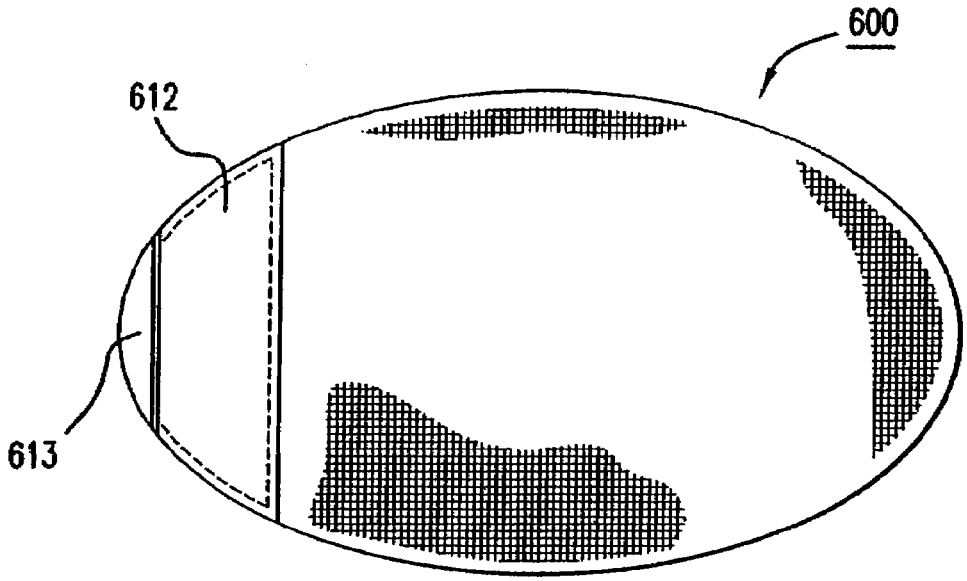
FIG. 17 shows a top view of a towel-mat according to another embodiment of the present invention.
Figure 18:
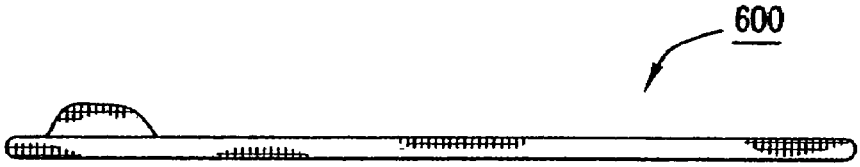
FIG. 18 shows a side view of the towel-mat shown in FIG. 17.

FIG. 17 shows a top view of a towel-mat according to another embodiment of the present invention. FIG. 18 shows a side view of the towel-mat shown in FIG. 17. Again, the details shown relate to the head portion 612, which is shown along three of its four sides to form an opening 613.

Figure 19:
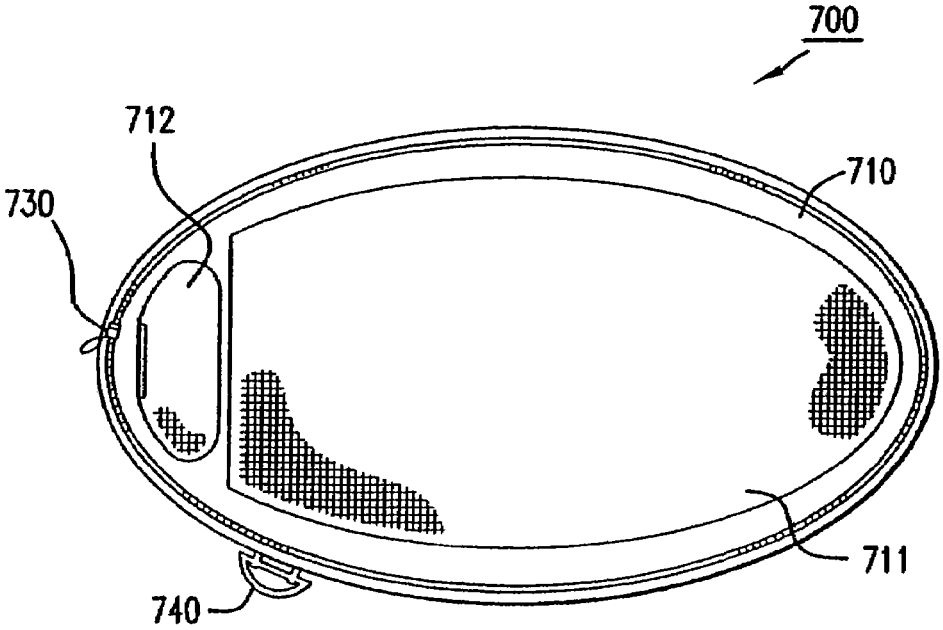
FIG. 19 illustrates a top view of a towel-mat with a frame member and removably attached membranes.
Figure 20:
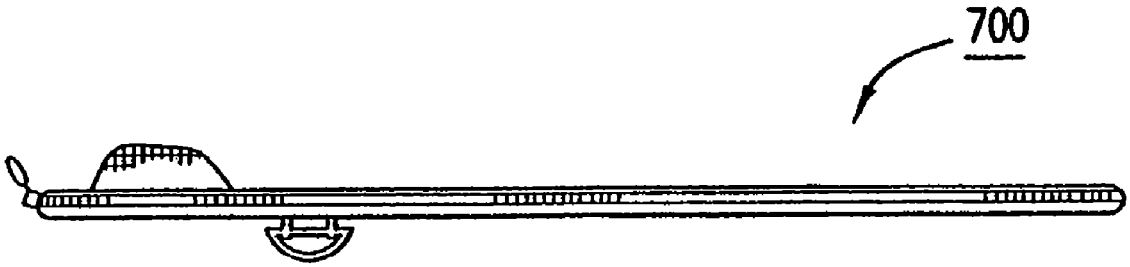
FIG. 20 is a side view of the towel-mat shown in FIG. 19.
Figure 21:
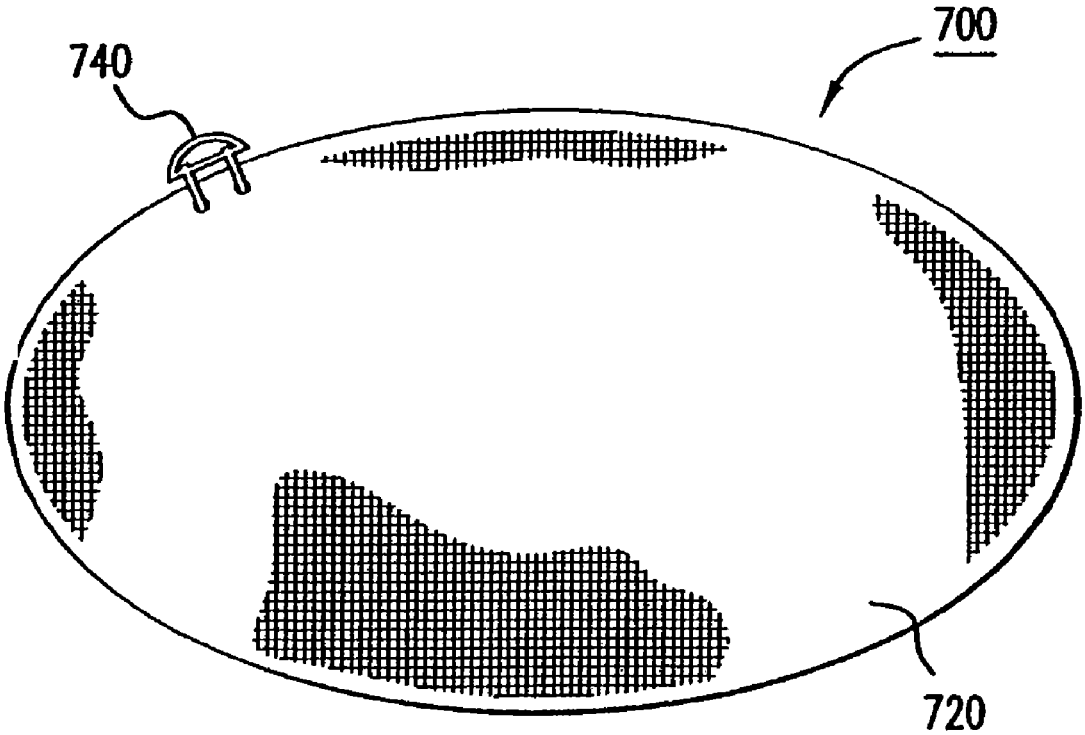
FIG. 21 shows a bottom view of the towel-mat shown in FIGS. 19 and 20.

FIG. 19 illustrates a top view of a towel-mat with a frame member and removably attached membranes. FIG. 20 is a side view of the towel-mat shown in FIG. 19. FIG. 21 shows a bottom view of the towel-mat shown in FIGS. 19 and 20. Towel-mat 700 includes top membrane 710, lower membrane 720, fastener 730 and pull ring 740. Top membrane 710 includes body portion 711 and head portion 712, which are fixedly attached to top membrane 710. Fastener 730 has one portion attached to top membrane 710 and another portion attached to lower membrane 720. The fastener can be located, for example, around the perimeter portions of top membrane 710 and lower membrane 720. The fastener shown in FIGS. 19 through 21 is a zipper.

Figure 22:
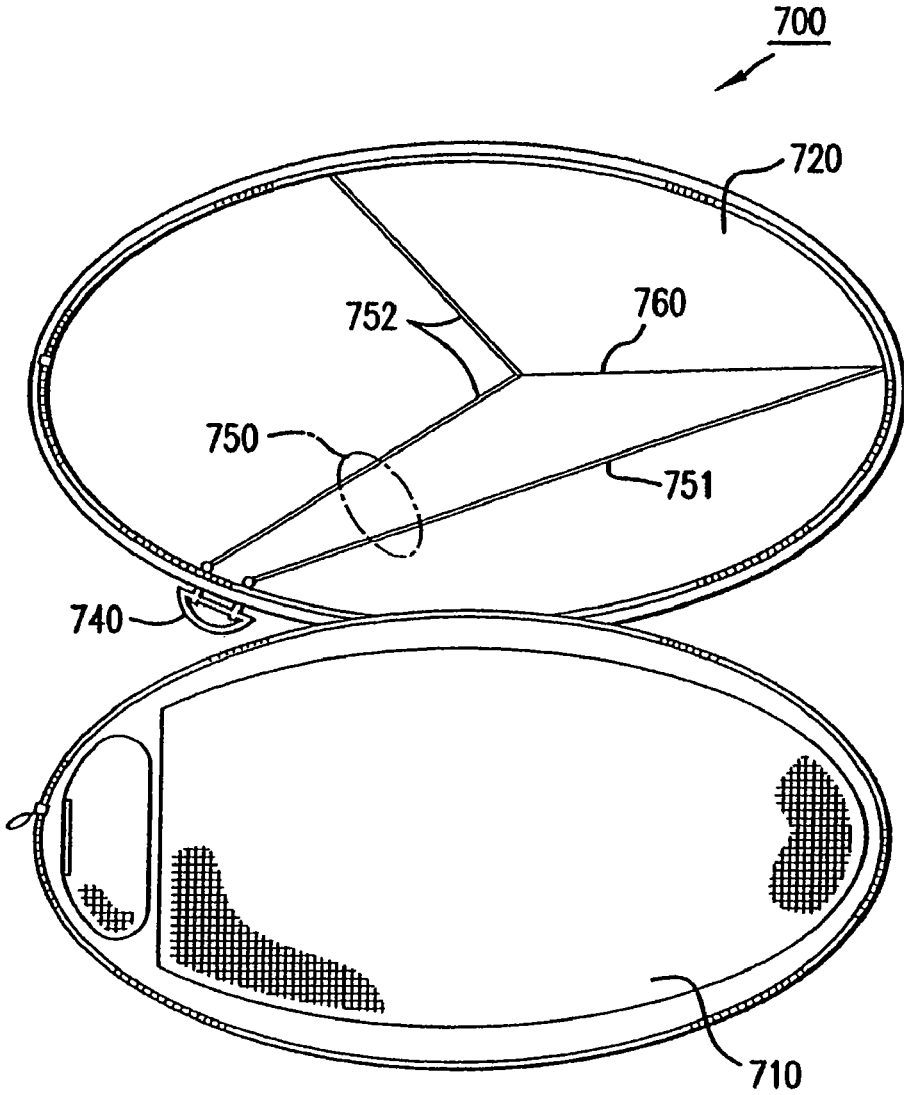
FIG. 22 illustrates a top view of the towel-mat shown in FIGS. 19 through 21 where the top membrane is separated from the lower membrane.

FIG. 22 illustrates a top view of the towel 700 shown in FIGS. 19 through 21 where the top membrane 710 is removed from the lower membrane 720. Note that the view of bottom membrane 720 is from a top view.

A cord 750 has cord sections 751 and 752, and is located within the lower membrane 720. Cord section 751 is fixedly attached directly to the frame member (not shown) or fixedly attached to the lower membrane 720 itself. The other end of cord section 751 is movably engagable through the lower membrane and connected to pull ring 740. Similarly, cord section 752 is also fixedly attached to either the frame member or the lower membrane 720 at a location angularly separated from the fixedly attached location of cord section 751. The remaining end of cord section 752 is movably engagable through lower membrane 720 and again connected to pull ring 740.

An elastic member 760 attaches to cord section 752, and to cord section 751 or a location on the lower membrane 720. As shown in FIG. 22, the elastic member 760 can have one end attached to cord section 751 where it fixedly attaches to the frame member or lower membrane 720 and the remaining end of elastic member 760 can be connected at point between the end points of cord section 752, for example, at a halfway point on cord section 752. Alternatively, the elastic member 760 can have its one end (the end opposite from the attachment at cord section 752) attached to the band (not shown) or to the lower membrane 720 itself. This end of elastic member 760 can be attached at any point along the band or the lower membrane 720 so that slack in the length of elastic member is taken up.

Note that the configuration of the cord with its cord sections (and the optional elastic member) shown in FIG. 22 is just one of many possible configurations. These other possible configurations are described in U.S. patent application Ser. No. 09/229,966, entitled *Collapsible Frame*, filed on Jan. 14, 1999 and which is incorporated herein by reference.

A user can convert the towel-mat from an extended configuration to a collapsed configuration by pulling pull ring 740. The extended configuration of the towel-mat is shown in FIG. 22. The towel-mat can also be converted to a collapsed configuration and a chair configuration which are described in U.S. application Ser. No. 09/081,134, entitled *A Self-Opening Towel*, filed on May 19, 1998 (now U.S. Pat. No. 6,170,100) and is incorporated herein by reference (see, e.g., FIGS. 3-8, 10-14 and their corresponding written description).

Figure 23:
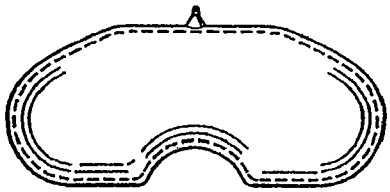
FIG. 23 shows a top view of a pillow according to an embodiment of the present invention.
Figure 24:
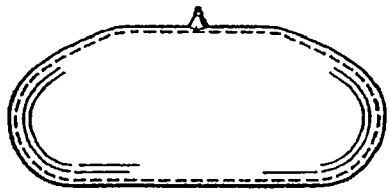
FIG. 24 shows a top view of a pillow according to another embodiment of the present invention.

FIG. 23 shows a top view of a pillow according to an embodiment of the present invention. FIG. 24 shows a top view of a pillow according to another embodiment of the present invention. As FIGS. 23 and 24 illustrate, the pillow can have varying types of shapes that allow them to be removably insertable into a pillow pocket for any of the towel-mat configurations discussed above. The pillow can be inflatable and deflatable for ease of storage and use.

Figure 25:
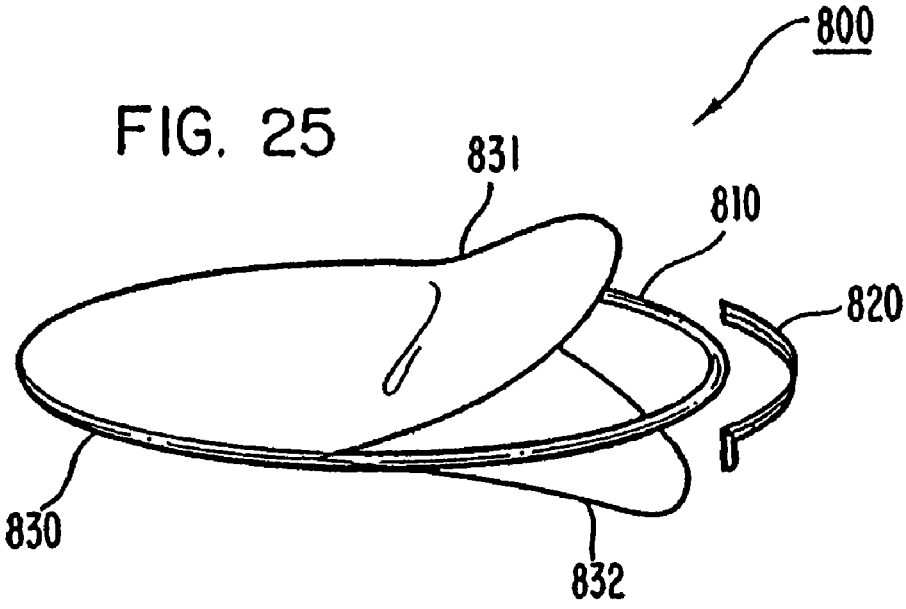
FIG. 25 illustrates a self-opening towel according to another embodiment of the present invention.

FIG. 25 illustrates a self-opening towel, according to another embodiment of the present invention. Self-opening towel 800 includes frame member 810, fastener 820 and covering membrane 830 which includes upper side 831 and lower side 832. Covering membrane 830 can be made of various types of appropriate materials. For example, the upper side 831 of covering membrane 830 can be made of terry cloth and can absorb moisture; the lower side 832 of covering membrane 830 can be made of nylon and can block moisture.

In this embodiment, the upper side 831 and lower side 832 of covering membrane 830 are connected along the perimeter except for the portion of the perimeter where fastener 820 is connected along the seam of the perimeter. For example, the upper side 831 and lower side 832 of covering membrane 830 are connected by a sewn seam along the perimeter of covering membrane 830. Covering membrane 830 can have dimensions of, for example, approximately 5'6"×3'6".

Fastener 820 can include a first portion which is attached to the upper side 831 of covering membrane 830 and a second portion which is attached to lower side 832 of covering membrane 830. Fastener 820 can be, for example, a zipper or a set of snaps. Where fastener 820 is a zipper, the two portions of the zipper can be sewn to the respective side of covering membrane 830.

Figure 26:
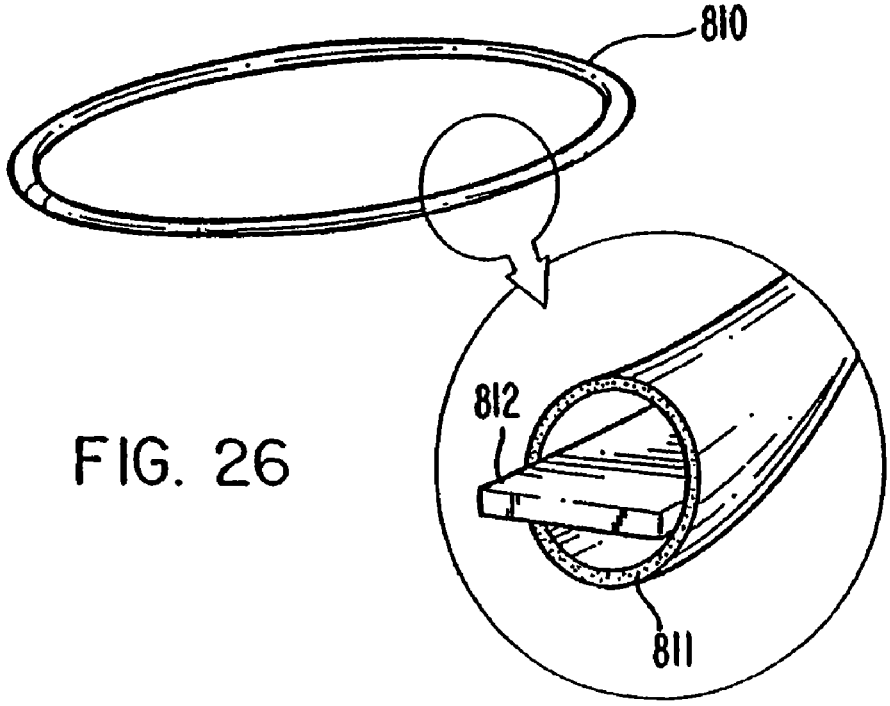
FIG. 26 illustrates a frame member of a self-opening towel, according to an embodiment of the present invention.

FIG. 26 illustrates a frame member of a self-opening towel, according to an embodiment of the present invention. In this embodiment, frame member 810 includes tube 811 and closed, spring-like loop 812. Closed, spring-like loop 812 can be made up of, for example, metal or any similar type of material. Closed, spring-like loop 812 can have dimensions appropriate to maintain the shape of self-opening towel 800 when in an extended configuration, yet flexible and twistable enough to allow the transition to or from an extended configuration, a collapsed configuration and/or a chair configuration. For example, closed, spring-like loop 812 can have the dimensions of ¼" by 1/16".

Tube 811 can be made of any sort of appropriate material such as rubber which is flexible yet sturdy enough to maintain closed, spring-like loop 812 being encased within the interior portion of tube 811. Tube 811 can be constructed of a waterproof material like rubber or plastic which can prevent water from contacting and rusting closed, spring-like loop 812.

Figure 27:
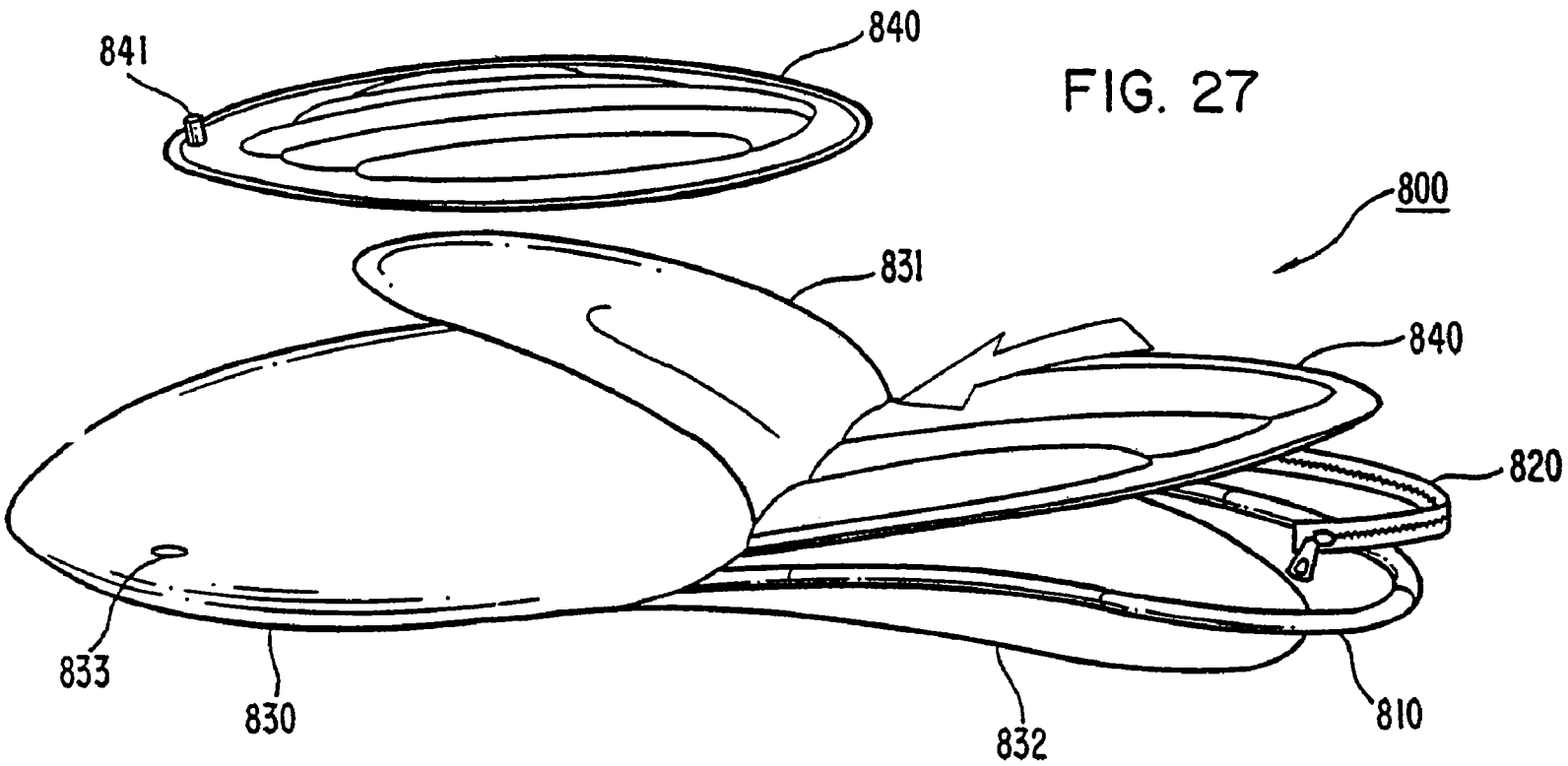
FIG. 27 illustrates an air-inflatable mat, according to an embodiment of the present invention, which can be inserted into an interior portion of a covering membrane.

Additional items can be also used in conjunction with a self-opening towel, for example, by inserting an additional item into the interior portion of a self-opening towel. FIG. 27 illustrates an air-inflatable mat, according to an embodiment of the present invention, which can be inserted into an interior portion of a covering membrane. More specifically, air-inflatable mat 840 can be inflated through a plug 841. Air-inflatable mat 840 can be inserted between upper side 831 and lower side 832 of covering membrane 830. Plug 841 can then be inserted through a hole 833 in upper side 831 of covering membrane 830. The air-inflatable mat 840 can be inserted into self-opening towel 800 when in an extended configuration and then removed when self-opening towel 800 is converted to a collapsed configuration or a chair configuration. Alternatively, air-inflatable mat 840 can be inserted into and retained within self-opening towel 800 when in an extended configuration, a collapsed configuration and/or a chair configuration. Air-inflatable mat 840 can be temporarily inserted into self-opening towel 800 by, for example, a hook-and-pile type of fastener, or permanently inserted into self-opening towel 800 by, for example, sewing air-inflatable mat 840 into covering membrane 830 of self-opening towel 800.

Figure 28:
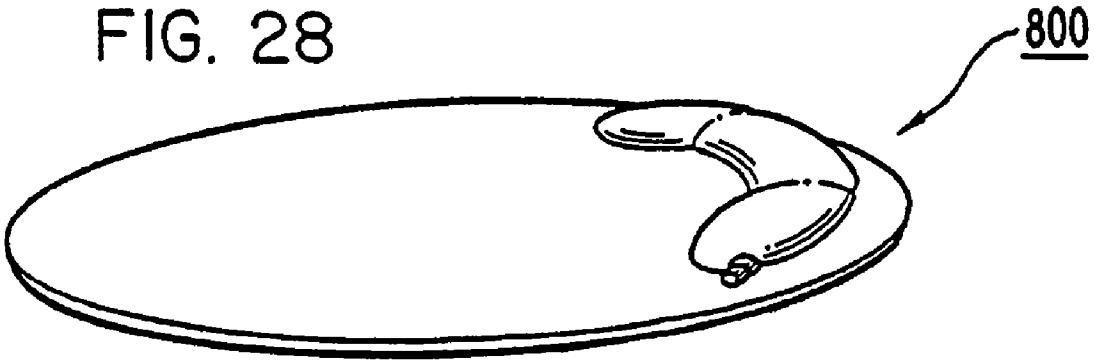
FIGS. 28 and 29 illustrate an air-inflatable cushion, according to an embodiment of the present invention, which can be inserted into an interior portion of a covering membrane.
Figure 29:
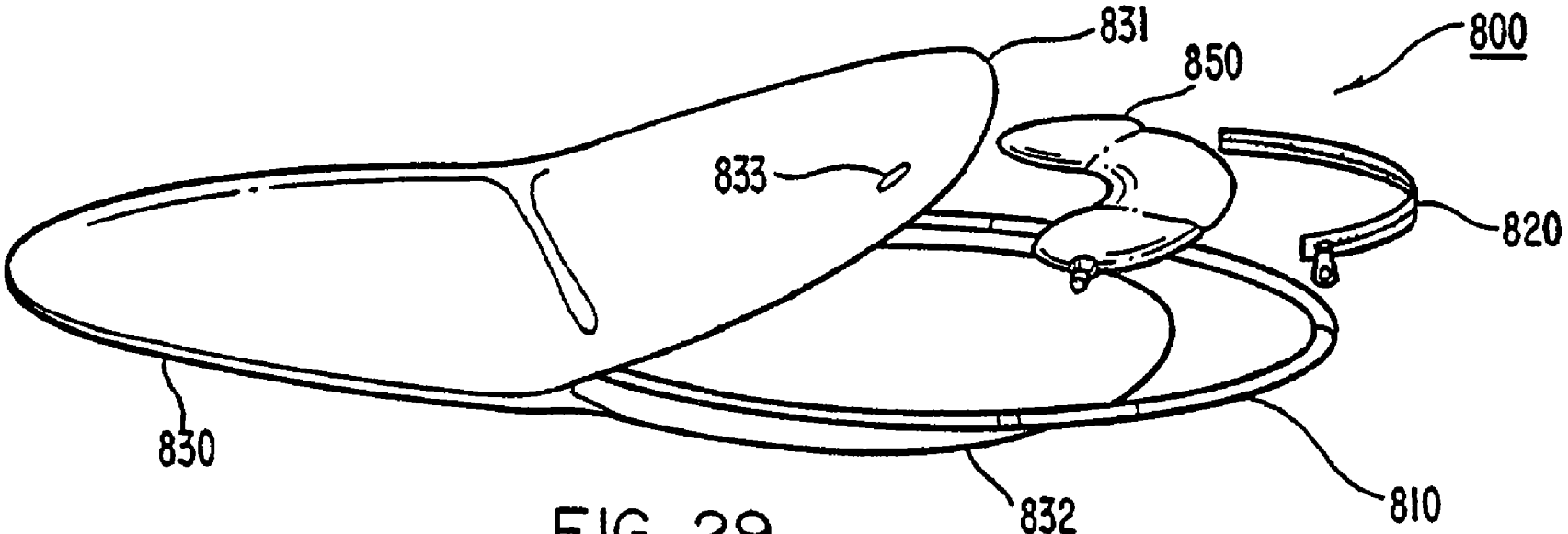

FIGS. 28 and 29 illustrate an air-inflatable cushion, according to another embodiment of the present invention, which can be inserted into an interior portion of a covering membrane. FIG. 28 shows an air-inflatable cushion inserted into self-opening towel 800; FIG. 29 shows the disassembled pieces of self-opening towel 800. As shown in FIG. 29, air-inflatable cushion 850 can be inserted between the upper side 831 and the lower side 832 of covering membrane 830. Upper side 831 of covering membrane 830 can include a hole 833 through which the plug on the air-inflatable cushion 850 can be inserted to provide access for inflating and deflating air-inflatable cushion 850. Of course, the air-inflatable cushion 850 can be inserted and removed through fastener 820 when the upper side 831 and lower side 832 of covering membrane 830 are assembled along the seam and assembled with the portions of fastener 820.

It should, of course, be understood that while the present invention has been described in reference to particular component shapes and configurations, other component shapes and configurations should be apparent to those of ordinary skill in the art. For example, although the band is shown and discussed as having a circular shape, the band can have a more rectangular shape with rounded corners. Although the cord sections are shown and discussed with having a common point of intersection, the cord sections can be interconnected at different points.

What is claimed is:

1. An apparatus, comprising:

a first membrane having a first portion and a second portion opposite the first portion, the first portion and the second portion collectively having a perimeter and defining a sleeve;

a frame member formed from a flexible twistable material, the frame member being disposed between the first portion and the second portion within the sleeve;

an inflatable bladder fixedly coupled to the first membrane, the inflatable bladder having a perimeter portion at least a portion of which is coupled proximate to the perimeter of the first membrane; and a second membrane coupled to the first membrane, the second membrane and the first membrane defining an opening therebetween, the second membrane being offset from the perimeter of the first membrane.

2. The apparatus of claim 1, wherein at least a portion of the inflatable bladder is disposed between the first membrane and the second membrane.

3. The apparatus of claim 1, wherein the inflatable bladder is a first inflatable bladder, the apparatus further comprising a second inflatable bladder.

4. The apparatus of claim 1, wherein the inflatable bladder is a first inflatable bladder, the apparatus further comprising:

a second inflatable bladder, the second bladder being disposed between the first membrane and the second membrane.

5. The apparatus of claim 1, wherein the perimeter portion of the inflatable bladder substantially corresponds to the perimeter of the first membrane.

6. The apparatus of claim 1, further comprising a frame member covering, the frame member being substantially encased by the frame member covering.

7. The apparatus of claim 1, wherein the first membrane and the second membrane define a cavity therebetween, the cavity having a maximum width, the opening being configured to provide access to the cavity, a width of the opening being smaller than at least the maximum width of the cavity.

8. A method, comprising:

disposing a frame member formed from a flexible twistable material between a first portion of a first membrane and a second portion of the first membrane, the first portion of the first membrane being opposite of the second portion of the first membrane, the first portion of the first membrane and the second portion of the first membrane collectively having a perimeter and defining a sleeve within which the frame member is disposed;

fixedly coupling an inflatable bladder to the first membrane such that a perimeter of the inflatable bladder is proximate to the perimeter of the first membrane; and coupling a second membrane to the first membrane such that the second membrane is offset from the perimeter of the first membrane, the second membrane and the first membrane defining an opening therebetween.

9. The method of claim 8, wherein at least a portion of the inflatable bladder is disposed between the first membrane and the second membrane.

10. The method of claim 8, wherein the inflatable bladder is a first inflatable bladder, the method further comprising:

disposing a second inflatable bladder between the first membrane and the second membrane.

11. The method of claim 8, wherein the first membrane and the second membrane define a cavity therebetween, the cavity having a maximum width, the opening being configured to provide access to the cavity, a width of the opening being smaller than at least the maximum width of the cavity.

12. An apparatus, comprising:

a first membrane having a first portion and a second portion opposite the first portion, the first portion and the second portion collectively having a perimeter and defining a sleeve;

a frame member formed from a flexible twistable material, the frame member being disposed between the first portion and the second portion within the sleeve;

a first inflatable bladder fixedly coupled to the first membrane, the inflatable bladder having a perimeter portion substantially corresponding to the perimeter of the first membrane; and a second inflatable bladder fixedly coupled to the first membrane, the second inflatable bladder being offset from the perimeter of the first membrane.

13. The apparatus of claim 12, further comprising:

a second membrane fixedly coupled to the first membrane, at least a portion of the second inflatable bladder being disposed between the first membrane and the second membrane.

14. The apparatus of claim 12, further comprising:

a second membrane fixedly coupled to the first membrane, the first membrane and the second membrane define a cavity therebetween, the cavity having a maximum width, the first membrane and the second membrane further defining an opening configured to provide access to the cavity, a width of the opening being smaller than at least the maximum width of the cavity.

15. The apparatus of claim 12, further comprising a frame member covering, the frame member being substantially encased by the frame member covering.

16. A method, comprising:

disposing a frame member formed from a flexible twistable material between a first portion of a first membrane and a second portion of the first membrane, the first portion of the first membrane being opposite of the second portion of the first membrane, the first portion of the first membrane and the second portion of the first membrane collectively having a perimeter and defining a sleeve within which the frame member is disposed;

fixedly coupling a first inflatable bladder to the first membrane such that a perimeter of the first inflatable bladder is proximate to the perimeter of the first membrane; and fixedly coupling a second inflatable bladder to the first membrane such that the second inflatable bladder is offset from the perimeter of the first membrane.

17. The method of claim 16, wherein the second inflatable bladder is a pillow.

18. The method of claim 16, wherein the perimeter of the first inflatable bladder substantially corresponds to the perimeter of the first membrane.

19. The method of claim 16, further comprising:

fixedly coupling a second membrane to the first membrane such that at least a portion of the second inflatable bladder is disposed between the first membrane and the second membrane.

20. The method of claim 16, further comprising:

fixedly coupling a second membrane to the first membrane such that the second membrane is offset from the perimeter of the first membrane, at least a portion of the second inflatable bladder being disposed between the first membrane and the second membrane.

* * * * *